US005288034A

United States Patent [19]

Schönmeier et al.

[11] Patent Number: 5,288,034

[45] Date of Patent: Feb. 22, 1994

[54] SYSTEM FOR JOINING WEBS OF MATERIAL

[75] Inventors: Herbert Schönmeier, Düsseldorf; Peter Weiss, Neuss; Karl Thievessen, Grevenbroich; Ewald Welp, Erkrath; Runald Meyer, Willich; Manfred Weis; Egbert Most, both of Düsseldorf, all of Fed. Rep. of Germany

[73] Assignee: Jagenberg Aktiengesellschaft, Dusseldorf, Fed. Rep. of Germany

[21] Appl. No.: 752,632

[22] PCT Filed: Mar. 6, 1990

[86] PCT No.: PCT/EP90/00362

§ 371 Date: Aug. 27, 1991

§ 102(e) Date: Aug. 27, 1991

[87] PCT Pub. No.: WO90/10591

PCT Pub. Date: Sep. 20, 1990

[30] Foreign Application Priority Data

Mar. 6, 1989 [DE] Fed. Rep. of Germany ..... 3907136

[51] Int. Cl.[5] ..... B65H 19/20

[52] U.S. Cl. ..... 242/58.3

[58] Field of Search ..... 242/58.1, 58.2, 58.3

[56] References Cited

U.S. PATENT DOCUMENTS 3,780,960 12/1973 Tokuno et al. ..... 242/58.1
3,939,031 2/1976 Takimoto ..... 242/58.3
4,681,274 7/1987 Thievessen et al. ..... 242/58.3
4,705,226 11/1987 Goetz ..... 242/56 R
4,892,263 1/1990 Beisswanger ..... 242/58.3

FOREIGN PATENT DOCUMENTS 299180 5/1988 European Pat. Off. .
3601296 7/1987 Fed. Rep. of Germany .
3440107 11/1988 Fed. Rep. of Germany .
1241568 8/1960 France .
2028045 10/1970 France .

*Primary Examiner*—Daniel P. Stodola
*Assistant Examiner*—John Q. Nguyen
*Attorney, Agent, or Firm*—Herbert Dubno; Yuri Kateshov

[57] ABSTRACT

A system for joining the end of a web of material (4) running off a first winding roll (17) with the beginning of a web on a new winding roll (1) interchanged with the first winding roll (17) on an unwinding machine comprising devices for cutting through the web (4) being wound off, for holding the end of the web so produced, and for pressing the end of the web against the periphery of an interchanged new winding roll (1), in order to produce an adhesive bond, has a splice element (6) which can be placed on the web being wound off (4), moved beyond the region of a full winding roll (1) and pressed against its periphery. The splice element (6) contains a web cutting element (15) and a holding element (16) which, when placed in contact with the web being wound off (4), is located behind the web-cutting element (15) in the direction of motion of the web.

13 Claims, 9 Drawing Sheets

SYSTEM FOR JOINING WEBS OF MATERIAL

CROSS REFERENCE TO RELATED APPLICATIONS

This application is a national phase of PCT/EP90/00362 filed 6 Mar. 1990 and based, in turn, upon German national application No. P39 07 136.7 filed 6 Mar. 1989, under the International Convention.

FIELD OF THE INVENTION

The invention relates to a system for joining the end of a web of material running off a first winding roll with the initial portion of a web of new winding roll replacing the first. More particularly the invention relates to a system for joining the end of a web of material running off a first winding roll with the initial portion of a web of a new winding roll having means for severing the running off web, for holding the thus-created web end and for pressing the web end against the outer circumference of the new replacement winding roll, in order to achieve an adhesive bond.

BACKGROUND OF THE INVENTION

In unwinding machines for winding rolls of webs of material, e.g. paper or cardboard webs, splice devices are known which join the end of a web of material running off towards a processing machine with the web beginning of a new roll. If the machine comprises stationary fastening devices for the winding rolls, then in stationary processing machines the roll remnant is cut off, the separated end of the running off web is held tight and, after the roll remnant has been removed and a new winding roll has been inserted, it is fastened, e.g. glued, to the new roll.

For the automation of the splice process, the German Pat. No. 14 40 107 proposes a generic device comprising a storage device for storing the material of the running web of material, a cutting device for the separation of the running web and between the cutting device and the storage device a driven suction roller which receives a part of the stored supply of web material bringing it in pressure contact with the outer circumference of a new roll, in order to achieve an adhesive bond with the initial portion of the new roll provided with an adhesive strip.

The suction roller is mounted on a swivel arm whose fulcrum is located above the maximum outer diameter of the new roll and which extends substantially horizontally when in the rest position. The construction of the therein described device is expensive because for the clamping of the running web, the movements of the storage device, the rotating and swinging motions of the suction roller, for the cutting device and for turning on the suction air, separate drives are required for each of these operations. Besides, the cutting blade has to be separately removable from its cutting position, since it is in the path of the running web during its unwinding. These necessary drives require an expensive control unit. Furthermore, this device is less suitable for use in drum-type unwinding machines arranged immediately upstream of roll-cutting and winding machines.

OBJECT OF THE INVENTION

It is the object of the present invention to provide a device of this kind which can be used even in conditions of reduced space, with the lowest possible expense from the point of view of construction and control techniques.

SUMMARY OF THE INVENTION

This object is attained in an apparatus which comprises a splice element which can come to rest against the running off web and is movable outside the range of a full winding roll and can be pressed against its outer circumference, this splice element comprising a web-cutting element and a holding element, which when pressed against the running off web is located behind the web cutting element in the direction of the web travel.

According to the invention, the elements for cutting the unwinding web, for holding the so-created end portion of the web and for pressing it against the outer circumference of the new replacement web are incorporated in a single splice element, thereby reducing the expense for its construction, e.g. by reducing the number of drives.

A further advantage of the device according to the invention is the fact that it can be used in unwinding machines with various discharge directions of the paper web, even with alternating discharge directions.

In order to maintain the tension of the running off, separated web during the movement of the splice element, the latter is provided with a rotary drive, with adjustable torque.

The movement of the splice element required for the splice process is advantageously performed by swivel levers, in order to be able to glue the web beginning of full rolls with large diameter differences to the running-off web. According to a feature of the invention, the splice element is linearly movable in lateral guides. An exclusively linear motion is possible, but it limits the diameter of the new rolls to be joined to a certain range. The combination of a linear motion with a swivel motion by means of linear guides mounted on swivel levers is preferred, since it provides a large range for the selection of the application point, respectively pressure point, of the splice element to the full roll. This is particularly advantageous when winding rolls are unwound from above as well as from underneath.

An embodiment with the suction zones arranged on both sides of the cutting element is capable of insuring the joining when the web is drawn off from above, as well as when it is drawn off from underneath.

A clamping element enables an automatic switching from an upper web discharge to a lower web discharge and vice versa.

The splice element can have an advantageous web cutting and web holding element, wherein the newly created web end is held in place by needles. Alternately or additionally to the mechanical holding of the web, e.g. in the case of stiff paper types, holding by air suction can be used. Needles arranged on both sides of the cutting element make possible the use even with changing direction of the roll rotation.

On elastic outer surface of the splice element insures a uniform pressure over the entire width of the web. Alternately, the splice element an be built in subdivisions over the web width, in order to be able to adjust to a nonlinear course of a full roll.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
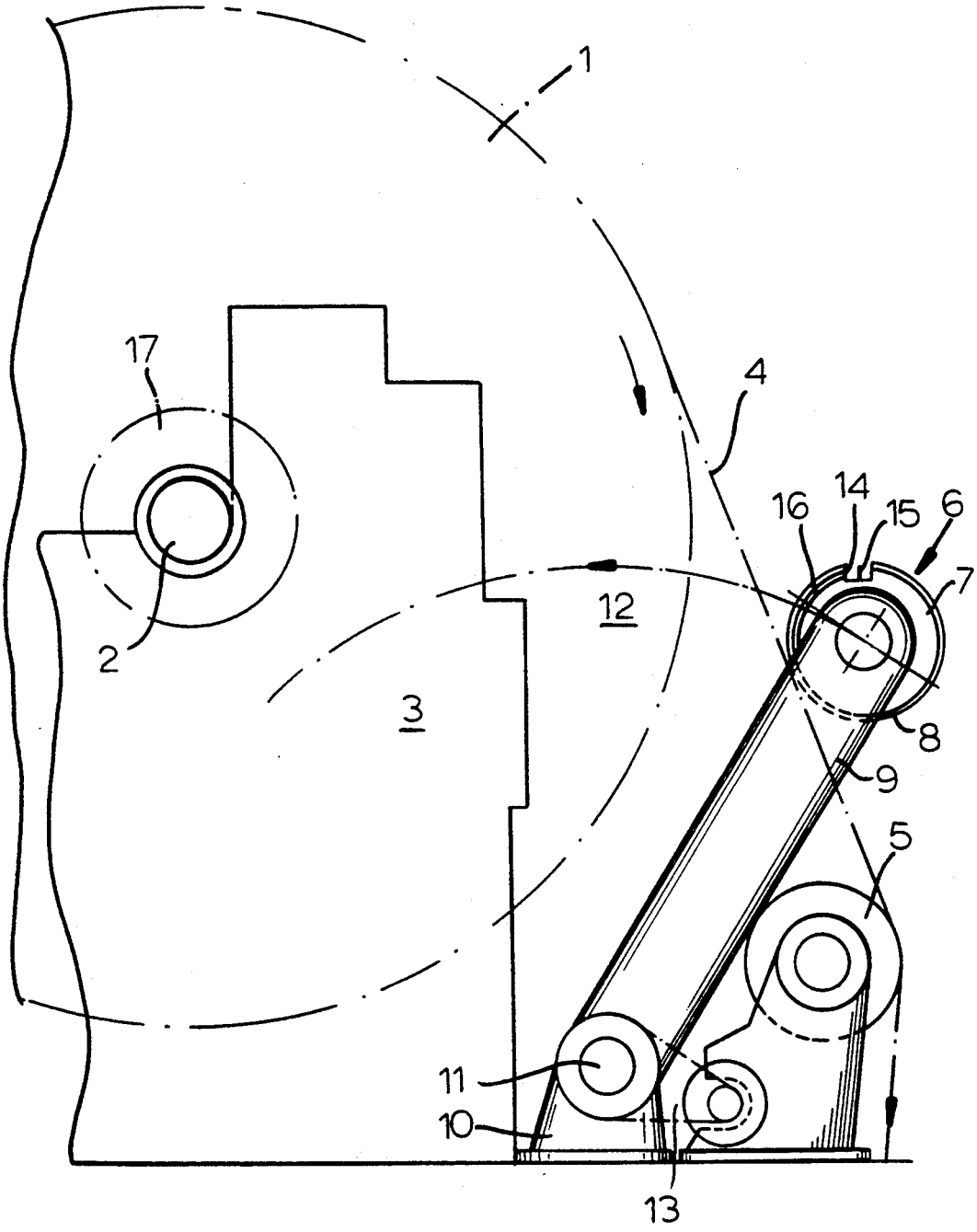
FIG. 1 is a partial side view showing the construction and operation of a system in a lateral view the construction and modus operandi of a system according to the invention for joining the running off web with a new roll, with downward web discharge.
Figure 2:
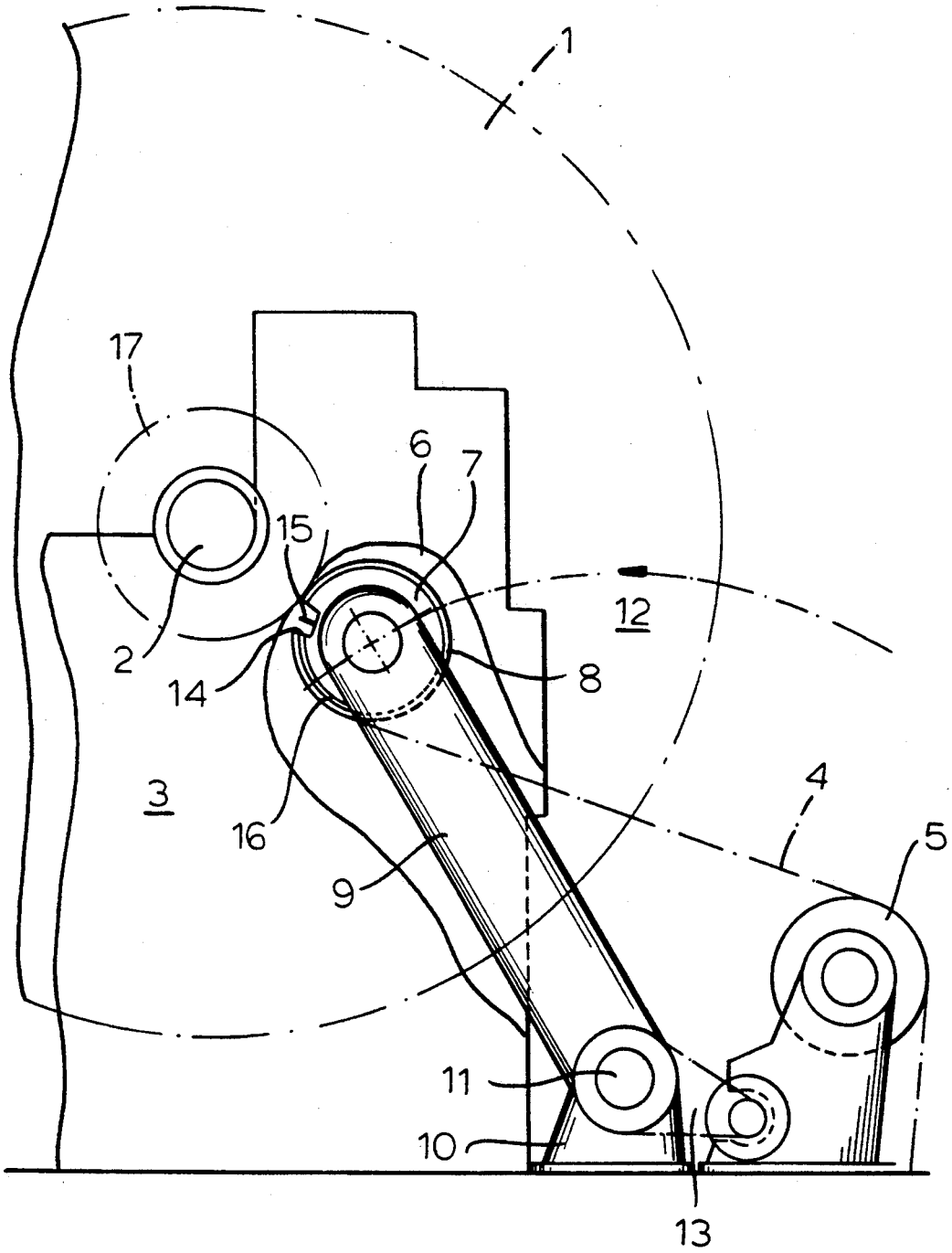
FIG. 2 is a view similar to FIG. 1 showing the parts in another position.
Figure 3:
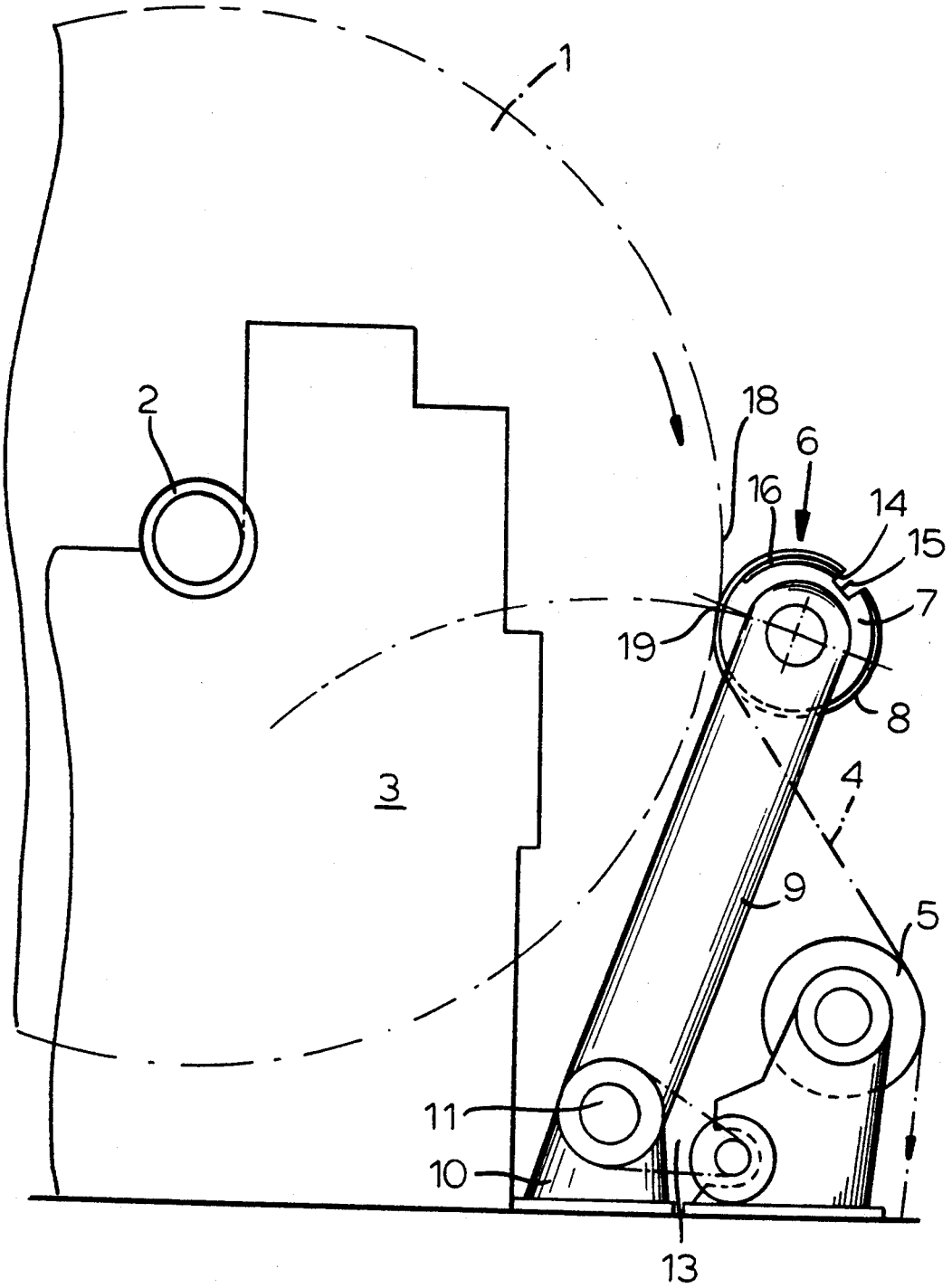
FIG. 3 is a side view showing another operative position of the parts.

The embodiment of the invention illustrated in FIGS. 1 to 3 serves for joining the end of a running off web with the beginning of web of a new master roll, whereby the rolls are suspended in such way that the web is drawn off from above. Therefore, during unwinding the rolls rotate clockwise, when the web — as can be seen in FIGS. 1–3 — is discharged towards the lower right.

The device serves for the unwinding of paper rolls which are rolled onto traversing metal axes called drums and, at a web width of 8 m and more, can reach a weight of over 50 T. In FIG. 1, a lateral view after the start of the unwinding process is shown. The still full master roll 1 is suspended with its drum 2 in an unwinding stand with two lateral supports 3. An available lateral brake dynamo, which can brake the winding roll during its generating operation, as well as actuate it during its driving operation is not shown in the simplified drawing. The paper web 4 is drawn off from above and is slightly deflected and guided by a guide roller 5 towards the subsequent roll cutting and winding machine, where it is longitudinally sectioned into individual webs and wound on smaller winding rolls.

The system according to the invention for joining the end of a running off web with the beginning of a new master roll comprises as essential features a holding element for the running off web, a cutting element succeeding in the direction towards the web end, and a pressing element pressing the fastened web portion of the running off web against the utmost layer of the new master roll and therefore arranged within the range of the holding element or in front of it considered in the direction towards the web end. According to the invention, these three elements are advantageously incorporated as a unit in the splice element 6, which is described in greater detail below.

A tube 7 with an elastic, e.g. rubbery, surface 8 extending over the entire work width is rotatably supported at the free ends of two lateral levers 9 provided with a drive with adjustable torque, not shown in the drawing. At their other ends, these levers are linked pivotably about a swivel axis 11 to bearing blocks 10 fastened to the floor, so that the tube 7 can be swung from the position shown in FIG. 1 outside the web path of the paper web 4 in the direction of arrow 12 close to the support of drum 2, by means of a pivot drive 13.

The tube 7 has on its outside a groove 14 extending axially over the work width, wherein a cutting knife 15 is arranged as a web sectioning element, this knife being provided with a cutting drive and being movable radially from the groove Alternatively, on the tube 7 a traversing knife, i.e. a knife movable across the work width, can be provided. Counterclockwise the groove 14 is followed by a suction zone 16 also extending over the work width, which is formed by a multitude of suction openings. An air-suction device not shown in the drawing serves for the production of underpressure inside the tube 7.

The system according to the invention operates as follows:

When during unwinding the master roll 1 is unwound down to a predetermined remnant, the unwinding process is stopped. The size of the remnant is selected so that at standstill at least three to four paper layer, are still on the drum 2. Shortly before the standstill of the roll remnant 17, the splice device 6 is brought in the direction of arrow 12, swivelled against the tautly stretched paper web 4, so that at standstill the suction zone 16 lies flatly against the web 4 and the suction openings are sufficiently covered. In the swung-in position shown in FIG. 2, the groove 14 and the cutting knife 15 are also covered by the web 4. The tube 7 lies thereby against the roll remnant 17 or stops at a short distance therefrom. Subsequently, an underpressure is generated in tube 7 by the air-suction ventilator, so that the web 4 adheres along the suction zone 16. After that, the web is cut across with the knife 15 (sic), the roll remnant 17 is removed from bearers 3 and the splice element 6 is swung back so as to allow the insertion of a new roll 1. When swinging back, the tube 7 is rotated clockwise, so that the web is kept tautly stretched due to the movement of the suction zone 16 against the travel direction of the web. The tension of the web is thereby adjusted through the torque of the rotary drive of tube 7 and is basically kept constant.

To the initial web portion of the new roll 1 a joining seam 18, e.g. a two-faced adhesive strip or a trace of glue, has been applied prior to roll insertion. The new roll 1 has been suspended and turned so that the joining seam 18 is at a distance from the pressing point 19 of the tube 7, considered against the direction of rotation of roll 1, which is shorter then the roll remnant held against the tube 7 behind the pressure point 19. In order to join the end of the running off web 4 with the web beginning of roll 1, the tube 7 is then swung towards the full roll 1 and pressed against it (FIG. 3). By switching on the advance mechanism for the web 4, e.g. the following winding-up machine, the tube 7, as well as the roll 1 entrained by friction contact start to rotate. Thereby the joining seam 18 moves through the roller gap subjected to pressure at the pressure point 19, and in this way a lasting adhesive bond between the remainder of web 4 and the initial portion of roll 1 is established.

The acceleration of roll 1 from the standstill, particularly with very high roll weights, can be triggered either with the support of the drum drive or by itself. It is advantageous when the roll 1 — as previously described — is at least partially moved by the running off web 4, since then this can be kept stretched tautly. Suitably, a control is provided, which triggers the additional support of the drum drive when an acceptable tension of the web is surpassed.

After the joining of the two webs, the splice element 6 is swung away from the web 4, until it reaches the waiting position shown in FIG. 1. This motion of swinging away from the full roll 1 takes place initially also by pressing the now-joined web 4, in order to keep it taut all the time. Subsequently, the newly inserted roll 1 can be accelerated to the operational speed.

Figure 4:
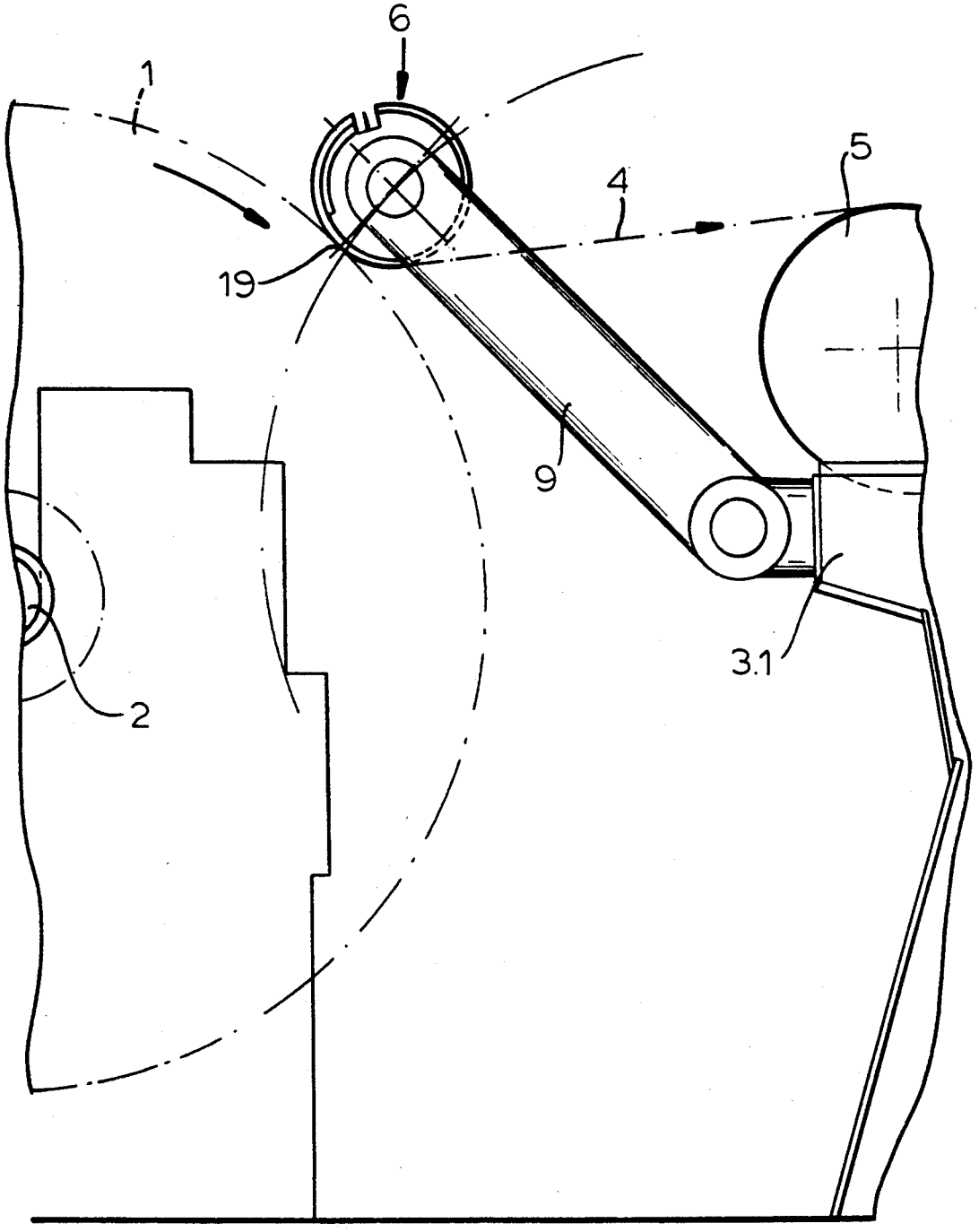
FIG. 4 is a lateral view of an embodiment having only a slightly inclined web path of the drawn-off web.

In FIG. 4, an embodiment of the invention suited for very tight space conditions and with a guide roller 5 arranged approximately at the height of the drawn-off web 4 is shown. Thereby, the web 4 is drawn off the full roll 1 in a direction which is only slightly downwardly inclined. In this embodiment, the swivel levers 9 are not in the floor area, but are articulatedly supported in a frame 3.1 at a height corresponding to the required length of the levers 9. Except for this difference, the arrangement according to FIG. 4 corresponds to the one shown in FIGS. 1 to 3, since there the web 4 is also being drawn-off from above, so that during unwinding the roll 1 turns also clockwise.

Figure 5:
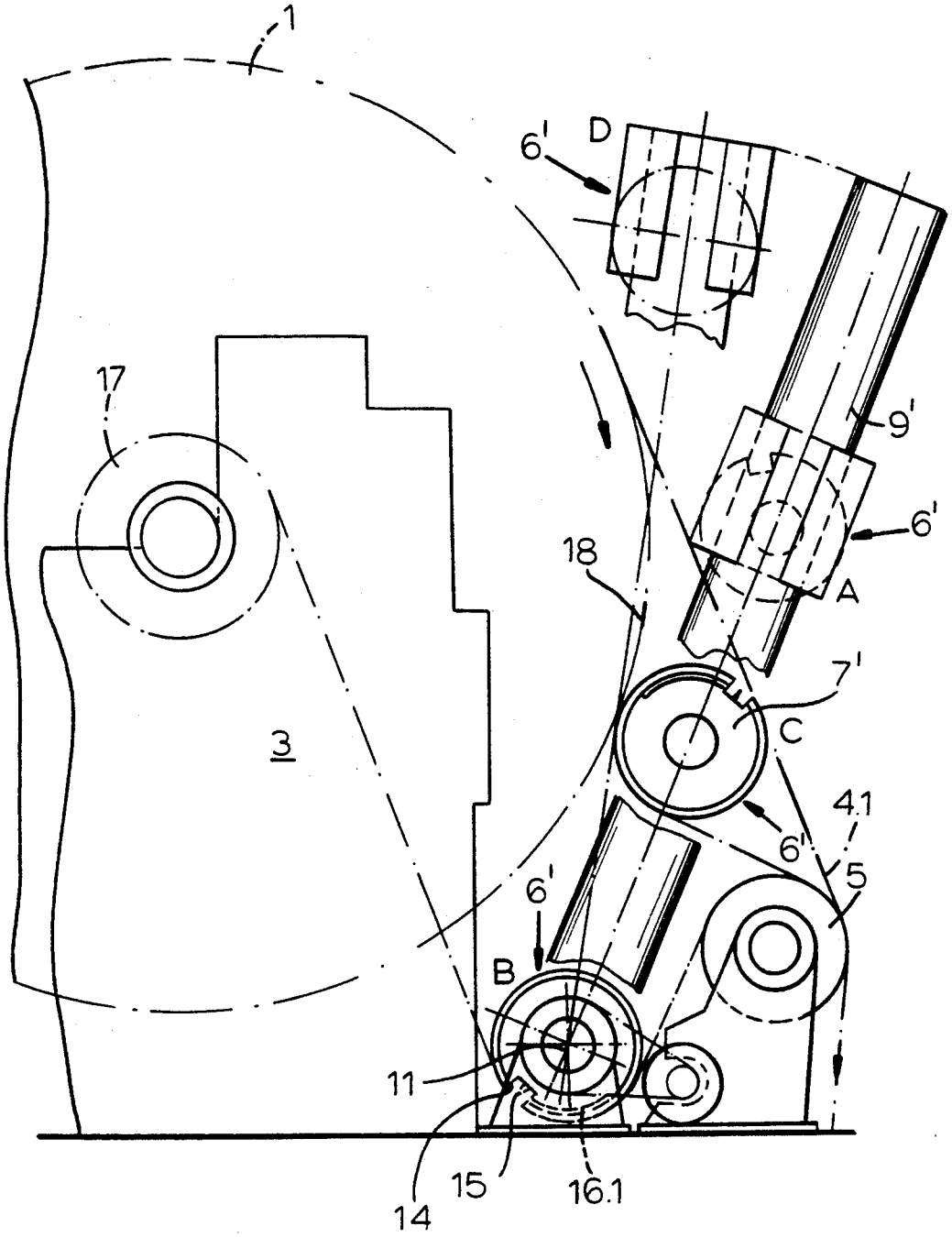
FIGS. 5 and 6 are a lateral view of an embodiment suitable for use in web discharge from above and from underneath with FIG. 5 illustrating the operation with upper web discharge and FIG. 6 the operation with lower web discharge.
Figure 6:
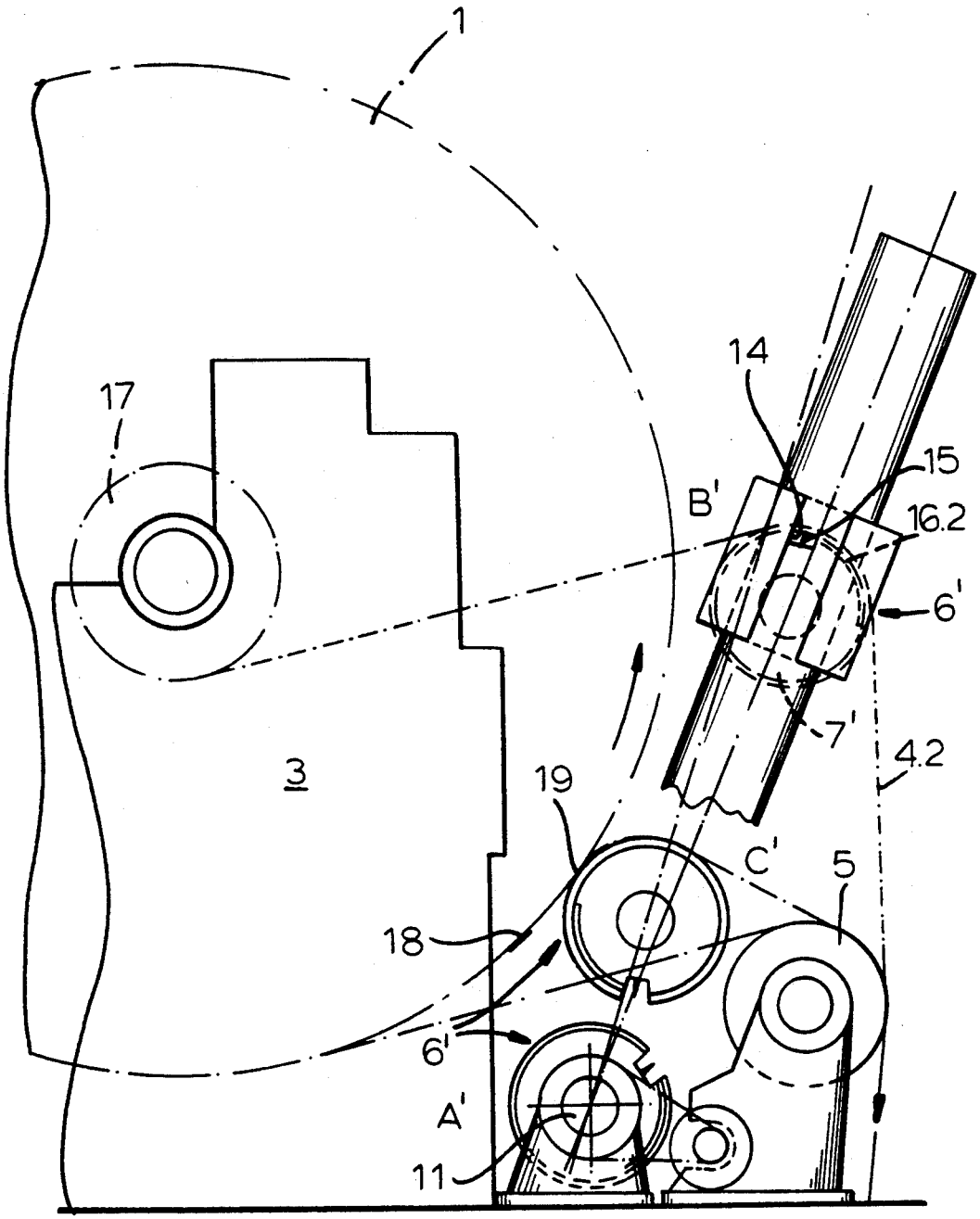

In FIGS. 5 and 6 an embodiment of the invention is shown which can be used advantageously for unwinding with upper web discharge (FIG. 5), as well as with lower web discharge (FIG. 6). Furthermore, this embodiment is suitable for use in limited space conditions.

The construction of the embodiment according to FIGS. 5 and 6 corresponds to the previously described device according to FIGS. 1 to 3, whereby as an additional feature the splice element 6' is mounted in the swivel levers 9' so that is adjustable in their longitudinal direction. The length of the swivel levers 9' and the adjustment path of the splice element 6' are thereby so selected that in a swung out position with respect to a full roll 1, the splice element 6' can travel above the web path 4.1 in a system with upper web discharge (position A in FIG. 5), as well as below the web path 4.2 in a system with lower web discharge (position A' in FIG. 6). For this purpose the tube 7' is supported at each of its two ends in a carriage which can travel within guides extending over length of the swivel levers 9', by means of a motor. In the present example, on each carriage a motor with a driving pinion is provided, each meshing with the toothed racks fastened to the swivel levers 9'. The tube 7' has a suction zone 16.1, 16.2 on each of the two sides of groove 14.

The operation of the system with upper discharge of the web 4.1 is schematically illustrated in FIG. 5:

After the start of the unwinding process, the splice element 6' is in the rest position A above the path of web 4.1. With the decreasing diameter of the master roll 1, the web path wanders downwards until a certain predetermined diameter of the roll remnant 17 is reached and the unwinding process is stopped. Subsequently the splice element 6' in the swivel lever 9' is moved downwards until the tube 7' plunges into the web 4.1 (broken line in FIG. 5, position B).

The tube 7' is turned into the cutting position, wherein the groove 14, as well as the suction zone 16.1 are flatly covered by the web 4.1. Subsequently, the air-suction device is switched on in order to hold the web 4.1 and the web 4.1 is sectioned by the knife 15. After cutting, the roll remnant is removed from bearers 3 and the splice element 6 is moved upwards in the swivel levers 9'. During the upward motion, the tube 7' is turned clockwise in order to maintain the tautness of web 4.1. In this way the splice element 6' reaches position C, whereby optionally the swivel levers 9' are further swung in the direction of guide roller 5, in order to make room for a new full roll 1.

After the latter is suspended in supports 3 with a prepared joining seam 18, the tube 7' is swung against its outer surface and the adhesive connection between the end of the running off web 4.1 and the beginning of a new web is achieved in the aforedescribed manner. When the machine is restarted, the splice element 6' is moved back into the rest position A and thus into its initial starting position.

In FIG. 6 the operation of a system with a supply roll 1 with lower web discharged is roughly sketched. The splice element 6' is in rest position underneath the web 4.2 (position A'). This position corresponds to the position B in FIG. 5. In a roll suspended in this manner, the web path wanders upwards with the decrease of the diameter.

When the diameter of the roll remnant 17 is reached, the unwinding is stopped and the tube 7' is moved into position B', wherein the web 4.2 flatly covers the suction zone 16.2 and the groove 14 with the knife 15. In the position B' the sectioning and holding of the web 4.2 takes place in the described manner. Subsequently the roll remnant 17 is removed and a new roll 1 with a prepositioned joining seam 18 is inserted. The position of the joining seam 18 after the insertion of roll 1 is in the area underneath the pressure point 19.

The splice element 6 is subsequently moved against the circumference of roll 1, by being moved downwards in the swivel levers 9' and additionally by swinging the latter towards the roll 1. At the same time, the tube 7' is turned counterclockwise in order to keep the web 4.2 stretched tautly and to prepare a web remnant of definite length underneath the pressure point 19 at the roll 1 (position C').

In the mode of operation shown in FIG. 6 the adhesive bond is achieved by turning the full roll 1 counterclockwise and the tube 7' clockwise. As a result, the joining seam 18 is moved through the roller gap at the pressure point 19 and this way the connection between the two webs is established.

In principle it should also be possible to produce the connection with an exclusively rectilinear motion of the splice element 6', e.g. through stationary lateral guides for the splice element 6'. However, the additional swivelling possibility around the axis 11 as shown in the embodiment example according to FIGS. 5 and 6 has several considerable advantages:

First, the additional swivelling capability makes possible the operation with full rolls having large diameter differences. Furthermore, due to the combined linear and pivoting motion the pressure point 19 can remain the same in the case of changing diameters of the full rolls. This makes it possible to affix the joining seam 18 outside the bearers 3 and within an area which remains the same. In addition, the splice element 6' can be retracted completely from its work area (position D in FIG. 5), in order to make the area between the running off roll 1 and the guide roller 5 accessible for other purposes.

In the aforedescribed embodiment it is necessary to manually position the beginning of the web around the splice element 6' at the first splice process after a change of unwinding direction. The special configuration of the splice element 6', whose design and operation are shown in FIGS. 7 to 10 make possible an automatic joining with the initial web portion of a new supply roll which is unwound with a different direction of rotation than the preceding roll, i.e. the automatic exchange of a roll with upper web discharge according to FIG. 5 to a roll with lower web discharge according to FIG. 6 and vice versa.

The guide tube 7" shown in cross section in FIGS. 7 to 10 has a downwardly widening groove 14, wherein the knife 15 is centrally arranged. On each side of groove 14 extends a suction zone 16.1, 16.2. In addition, inside the tube 7" there is a clamping element 20 which is capable of clamping in the groove 14 the web end of the running off web 4 created after cutting with the knife 15. The clamping element 20 consists of levers 20.1 which are swingably supported at both ends of the tube 7" in the groove 14, outside the web area, a wire cable 20.2 being stretched between the free ends of these levers By means of a pivot drive, the wire cable is pivotable against both inner grooves walls and is therefore in a position to clamp down on web ends coming from both directions. In order to obtain a uniform clamping effect in bigger groove length, the clamping zone in the groove can be designed so that the wire cable 20.2 comes to lie against a curved line.

Figure 7:
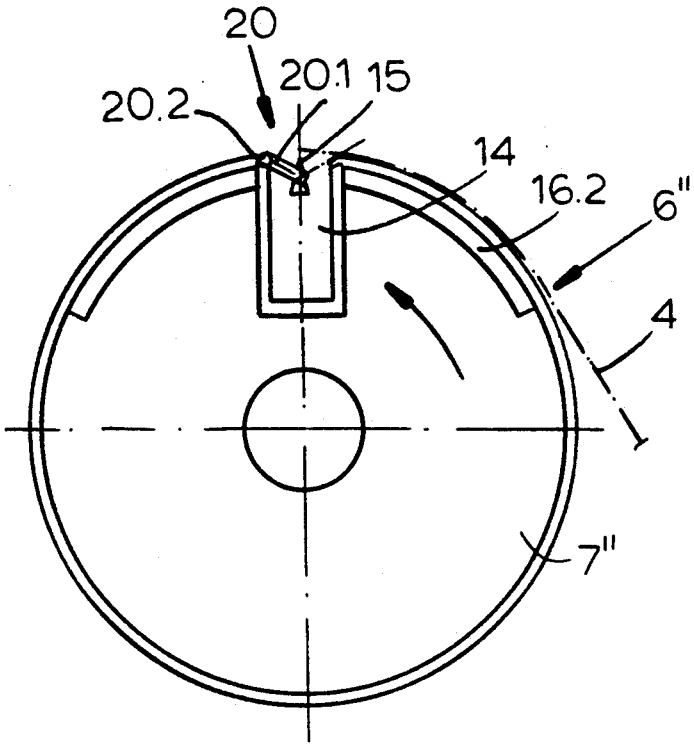
FIGS. 7–10 are diagrammatic sections showing roughly schematically a splice element with a clamping element for the end of the wound-off web, by means of which the joining of one roll to the next can take place in the case of change of the unwinding direction.
Figure 8:
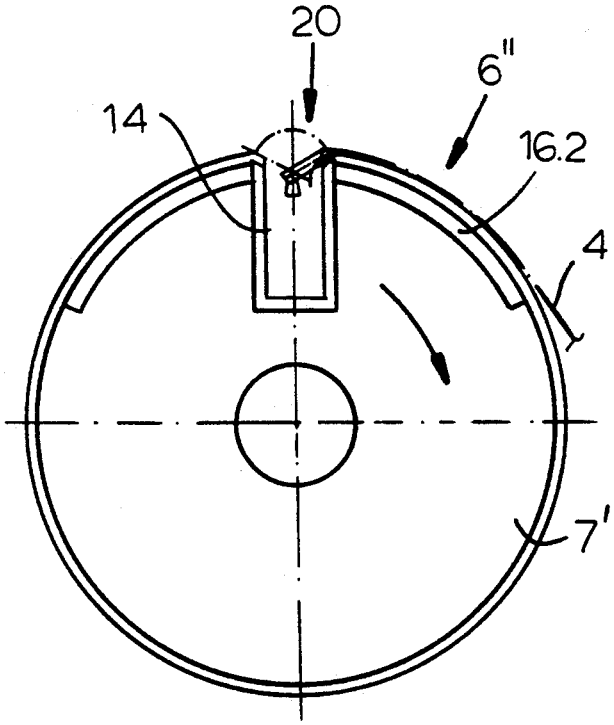
Figure 9:
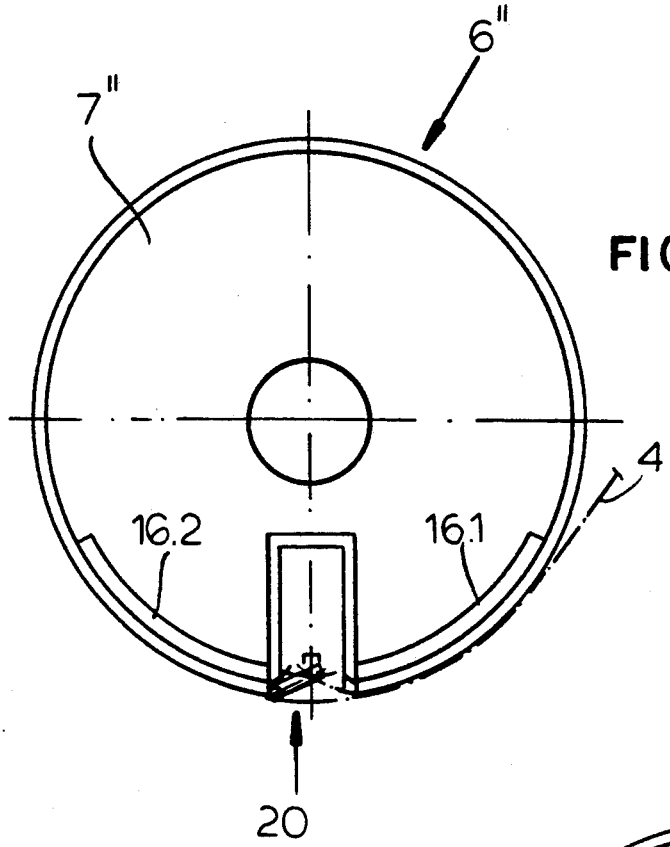
Figure 10:
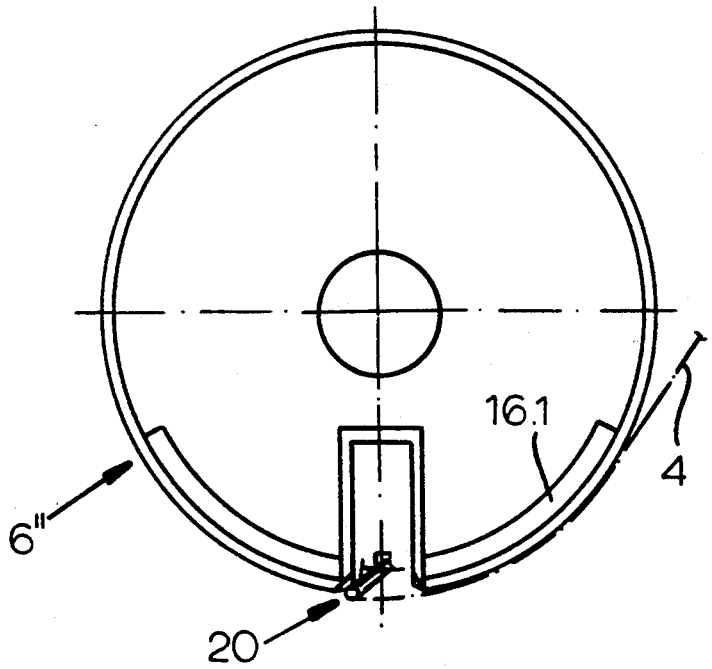

FIGS. 7 to 10 describe the operation of the splice element 6" during the switch from a lower web discharge to an upper web discharge. In a lower web discharge (see FIG. 6) tube 7" rotates counterclockwise in order to tension the running off web 4 and the active suction zone 16.2 succeeds directly clockwise the groove 14. After the running off web 4 is sectioned by the knife 15, the web end is held by the suction zone 16.2 (FIG. 7). Subsequently, the clamping element 20 swivels, grips the web end in the area of groove 14 and clamps it against the widening groove wall (FIG. 8). After the clamping is done, the air-suction device is shut off. During the following clockwise turning of tube 7, the web 4 held by clamping element 20 detaches itself from the suction zone 16.2 and is applied to suction zone 16.1 on the other side of the groove (FIG. 9). After the air-suction device is again switched on, the clamping element 20 is released and the running web 4 is kept in place solely by the suction zone 16.1 (FIG. 10). In this position, the splice element 6" is ready to perform the joining with the initial portion of a web coming from above. Insofar FIG. 10 corresponds to position C in FIG. 5.

At a change of the unwinding direction from an upper web discharge to a lower web discharge, the web end is correspondingly transferred from the suction zone 16.1 to the suction zone 16.2, whereby the rotation takes place in the opposite direction — also the direction of the paper travel — and the clamping element 20 clamps the web beginning against the opposite inner wall of groove 14.

Figure 11:
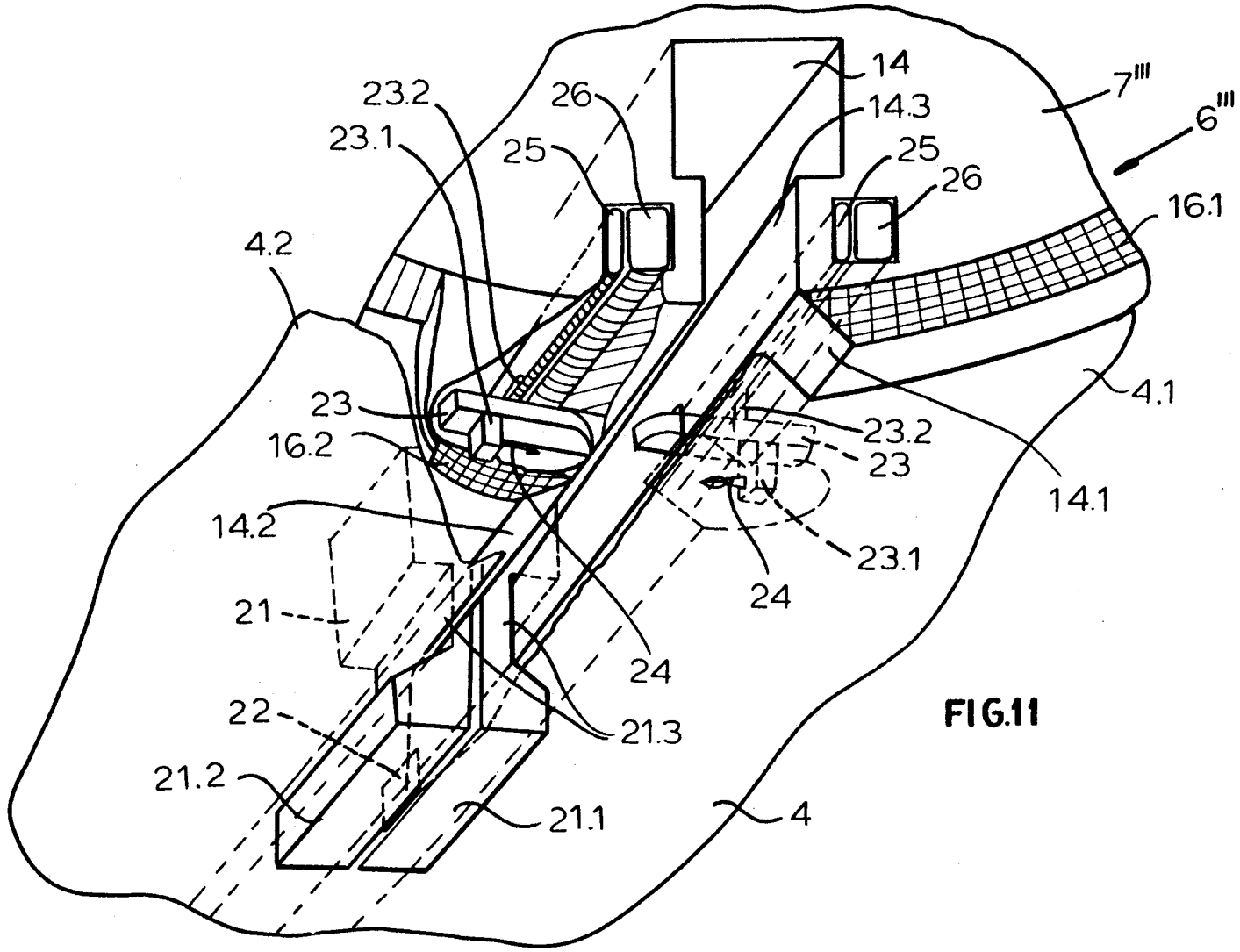
FIG. 11 is a partially sectioned perspective view of a further embodiment of the splice element, to be used in case of changing rotation directions of the supply rolls.

FIG. 11 shows a further development of a splice element 6''' or use in variable rotation directions of the supply rolls. In this embodiment too the suction tube 7''' has a groove 14 extending over its entire length, with outwardly slanted flanks 14.1, 14.2 in the surface region of tube 7''', next to which on both sides suction zones 16.1, 16.2 are provided. The groove 14 serves as a guide for a carriage 21 with a fitting cross section, which can be moved over the work width by means of a drive. The slanted flanks 14.1, 14.2 are followed immediately by parallel sides 14.3 of the groove 14 which subsequently widens again.

The carriage 21 fitted on the groove 14 in the manner of a slide fastener has two lateral walls 21.1, 21.2, and a cutting knife 22 for cutting the web 4 is fastened between them in the advance direction. The sides of the walls 21.1, 21.2 facing the flanks 14.1, 14.2 of the groove 14 run wedge-like towards the latter, in order to press the edges of web 4 created as a result of the cutting against the slanted flanks 14., 14.2.

On both sides of groove 14 in the suction tube 7''', equally spaced apart rams 23, movable in the direction of the groove 14 are arranged, and their ends rounded in cutting direction can be moved through openings in the groove walls 14.3 in the area of groove 14. On its top side, each ram 23 has a holder 23.1 for a needle 24 provided with a barb, which engages through openings in the slanted flanks 14.1, 14.2 at a corresponding movement of the rams 23 in the area of groove 14. As needles 24 (sic) the pins known in the paper industry or also pointed screws can be used.

At its bottom side each ram 23 has a plate-shaped protrusion 23.2 which is clamped between two hoses 25, 26 actuated by compressed air and extending over the entire length of suction tube 7'''. Each ram 23 with its needle 24 engages in the area of groove 14 when the respective outer hose 25 is pumped up, and disengages from the area of the groove 14 when the inner hose 26 is pumped up.

FIG. 11 shows the sectioning of the web during a change in the unwinding direction from upper web discharge to lower web discharge. The end of the running off web 4 which has to be fastened is marked 4.1, the web remnant to be cut off from the roll remnant 17 is marked with the numeral 4.2. Prior to the sectioning of web 4, the rams 23 with needles 24 are moved in the area of groove 14 towards the web portion 4.1 to be held by pumping up the thereto pertaining outer hose 25. The rams 23 with needles 24 on the other side, are not within the range of groove 14, i.e. the inner hose 26 on that side contains compressed air, while the outer hose 25 is vented. Subsequently, the carriage 21 with the knife 22 is moved parallelly to the axis of tube 7''' through the groove 14 and in this way the web 4 is several. At this motion of the carriage 21, the portion 21.3 of the side wall 21.1 facing the groove wall 14.3 presses the rams 23 against a spring force generated by the pressure in hose 25 first out of the area of groove 14 and back into the suction tube 7'''. At the same time, the web edges created during cutting are tipped over and pressed against the flanks 14.1, respectively 14.2. During the further movement of the sled 21, the rams 23 with the needles 24 spring back instantly in the area of groove 14, as soon as they are no longer held back by the lateral walls 21.3. Thereby the needles 24 engage the web end 4.1 lying flatly against the flank 14.1 and hold it in place with their barbs. After hat, the air-suction device is switched off and during the following counterclockwise turning of tube 7 the web 4.1 detaches itself from the suction zone 16.1 and is applied against the suction zone 16.2, after the web remnant 4.2 has been removed. After the air-suction device is again turned on, the needles 24 are retracted from the area of groove 14 as a result of the supply of compressed air to the inner hose 26 and of the venting of the outer hose 25. In this position, the splice element 6 is ready to perform the joining operation with the initial portion of a web coming from underneath.

In case of change of unwinding directions from lower web discharge to upper web discharge, the web end is correspondingly shifted from suction zone 16.2 to suction zone 16.1. Then the needles 24 hold on the opposite side the initial portion of the web newly created by cutting, which in FIG. 1 is located to the left.

The embodiment of the splice element 6''' shown in FIG. 11 has the advantage that no holding element has to grip around the cutting knife when the rotation direction of the supply roll is changed. The hoses 25, 26 used for the movement of the needles 24 produce at the same time the spring force required for their sudden penetration of the web 4. Through the pressure in the hoses 25 it is possible to adjust the impact force of the needles 24 to the web material.

Even when the unwinding direction of the supply rolls does not change, it could be required in the case of stiffer paper types (e.g. cardboard) to additionally mechanically fasten the web ends with the needles 24 as shown in FIG. 11. Since the unwinding direction does not change, the needles have to be provided only on one side of groove 14.

Webs with sufficient tearing resistance can also be held exclusively mechanically by needles 24. If the required web traction can be achieved only with the needles 24 without the danger of tearing, the superficially acting suction zones 16.1, 16.2 are not mandatory and can be eliminated.

Advantageously the embodiments of the invention described in FIGS. 1 to 11 are built in the manner of a modular construction kit. Starting with the device according to FIGS. 1 to 3, it can be equipped or retrofitted with a linearly moving splice element 6' corresponding to FIGS. 5 and 6, in order to automatically join full rolls with upper or lower web discharge. By having the device according to FIGS. 5 and 6 equipped or retrofitted with the clamping element 20 shown in FIGS. 7–10, it becomes capable to achieve a fully automated web joining even during a simultaneous change of the unwinding direction of the full roll 1.

It is an essential advantage of the system according to the invention that the joining seam 18 does not have to be positioned exactly, but only within a certain range. This makes possible a very simple roll preparation of the new roll for the splice process and eliminates expensive control devices for the positioning of the joining seam 18 in order to achieve the adhesive bond, e.g. through rotation of the full roll.

We claim:

1. An automatic splicing device comprising:

a frame;

mounting means on the frame for sequentially receiving first and replacement rotatable unwinding rolls of a web of material to be spliced, the web of the replacement roll being formed with a leading end provided with adhesive thereon;

a guide roller mounted on the frame and spaced from the mounting means, the guide roller and a respective one of the unwinding rolls mounted on the mounting means defining a path of the web therebetween and being rotatable in one sense whereby a remainder of the roll and the guide roller lie at one side of the web;

a splice element mounted on the frame along the path between the guide roller and the respective one of the unwinding rolls and extending substantially across a working width of the web, the splice element comprising:

a tube having a longitudinal central axis engageable with a side of the web opposite to the one side and rotatable about said axis in a sense opposite to the one sense, said tube being provided with an axial groove;

cutting means mounted in said groove for cutting the web running off the first roll, thereby forming a trailing end of the web, and holding means on the tube for holding the trailing end of the first roll upon cutting of the web, said holding means being located downstream of the cutting means; and actuating means on the frame for displacing the splice element into a changing position toward a periphery of a replacement roll after mounting thereof on the mounting means, the holding means being urged against the periphery of the replacement roll in the changing position of the splice element thereby pressing the trailing end against the leading end, so that the ends are bonded together.

2. The automatic splicing device defined in claim 1 wherein the tube of the splicing element is a suction pipe rotatable about said axis and formed with said axial groove, the cutting means being a cutting knife mounted in the groove, the holding means including a plurality of suction holes forming a suction zone, the groove being formed with a pair of lateral walls.

3. The automatic splicing device defined in claim 2 wherein two pressure zones are formed on the pipe.

4. The automatic splicing device defined in claim 2 wherein the holding means further includes a clamping element mounted in the groove between the lateral walls.

5. The automatic splicing device defined in claim 4 wherein the clamping element is a wire cable mounted swingably in the groove, the wire cable clamping the trailing end against a respective one of the lateral walls after swinging toward the respective wall.

6. The automatic splicing device defined in claim 2 wherein:

the lateral walls of the groove are formed with a pair of parallel inner flanks and a pair of outer flanks running outwardly from the inner flanks and diverging from one another toward the periphery of the pipe, the cutting means including a sled displaceable along the groove and supporting the cutting knife, the sled being formed with respective lateral sides pressing the web against the outer flanks of the groove, the holding means further including a pair of rams supported on the pipe and selectively displaceable into the groove through a respective one of the lateral walls in a clamping position of rams.

7. The automatic splicing device defined in claim 6 wherein each of the rams is provided with a respective plurality of needles penetrating into the groove through a respective plurality of passages in the respective outer flank and clamping the trailing end of the web in the clamping position of the ram, each of the rams being displaceable out of the groove upon contact with a respective one of the lateral sides of the sled.

8. The automatic splicing device defined in claim 6 wherein the holding means further includes a plurality of hoses extending along opposite sides of the groove and pressurizable with compressed air, each pair of the hoses receiving a respective one of the rams for displacing the latter in the respective clamping position.

9. The automatic splicing device defined in claim 2 wherein the pipe is formed with an elastic peripheral surface.

10. The automatic splicing device defined in claim 1 wherein the actuating means includes at least one lateral swivelable lever mounted on the frame and formed with a respective free end, the tube being mounted rotatably on the free end.

11. The automatic splicing device defined in claim 1 wherein the splicing element is curv, linearly movable between extreme working positions corresponding to a full first roll and a depleted first roll, the splicing element being displaceable in the changing position between the extreme positions toward the periphery of the replacement roll.

12. The automatic splicing device defined in claim 1 wherein the splicing element is movable along an arcuate path between the changing position and an extreme working position corresponding to a depleted first roll, the holding means being in contact with the periphery of the first depleted roll in the extreme position.

13. The automatic splicing device defined in claim 1, further comprising a rotary drive with adjustable torque for the tube, so that a tension of the running off web is controlled during the displacement of the splice element.

* * * * *